United States Patent [19]

Thomson et al.

[11] 4,261,260

[45] Apr. 14, 1981

[54] PORTABLE TRANSACTION LOG RECORDER

[75] Inventors: Morton W. Thomson, South Easton; Heinz F. Strohschneider, Plymouth, both of Mass.

[73] Assignee: DBS, Inc., Randolph, Mass.

[21] Appl. No.: 65,861

[22] Filed: Aug. 13, 1979

[51] Int. Cl.[3] ..... B41F 3/04

[52] U.S. Cl. ..... 101/45; 101/407 BP

[58] Field of Search ..... 101/45, DIG. 10, 51, 101/269–274, 382 MV, 407 A, 407 BP; 74/411.5; 242/54, 71, 74.1, 84.5 R, 74.2; 228/91, 92; 400/581, 583.3

[56] References Cited

U.S. PATENT DOCUMENTS

| | | | |
|---|---|---|---|
| 1,988,195 | 1/1935 | Euth | 242/21 |
| 2,172,637 | 9/1939 | Fader | 271/2.4 |
| 2,556,812 | 6/1951 | Jordan | 271/2.6 |
| 2,776,834 | 1/1957 | Euth | 271/2.6 |
| 2,812,937 | 11/1957 | Robinson | 271/2.1 |
| 3,201,019 | 8/1965 | Goreham | 226/9 |
| 3,201,059 | 8/1965 | Winkel | 242/74.1 |
| 3,356,200 | 12/1967 | De George | 400/581 |
| 3,404,628 | 10/1968 | Lee | 400/583.3 X |
| 3,415,182 | 12/1968 | White | 400/581 X |
| 3,464,349 | 9/1969 | Rikerfeld | 400/583.3 X |
| 3,650,207 | 3/1972 | Black | 101/115 |
| 3,756,528 | 9/1973 | Ohmurn | 242/74 |
| 3,779,437 | 12/1973 | Yamamoto et al. | 225/965 |
| 3,795,356 | 3/1974 | Orthen | 226/58 |
| 3,838,641 | 10/1974 | McInnis | 101/269 |
| 3,841,580 | 10/1974 | Rodach | 242/75.2 |
| 3,917,048 | 11/1975 | Riley | 400/583 |
| 3,945,316 | 3/1976 | Thomson et al. | 101/45 |
| 3,965,820 | 6/1976 | Spradlin | 101/426 |
| 3,983,802 | 10/1976 | Thomson et al. | 101/45 |
| 4,059,051 | 11/1977 | Maul et al. | 101/45 |
| 4,085,675 | 4/1978 | Yoshikawa et al. | 101/269 |
| 4,113,192 | 9/1978 | Osanai | 242/1 |

*Primary Examiner*—Edward M. Coven
*Attorney, Agent, or Firm*—Gerald J. Ferguson, Jr.; Joseph J. Baker

[57] ABSTRACT

An improved portable cassette recorder for use in an imprinter or the like, the recorder being adapted to process fanfolded transaction log sheets or the like. The recorder includes a sensing pin mechanism which senses registration holes in the log sheets to ensure that data entry blocks in the log sheet are in registry with the recorder imprinting station. In order to advance the log sheet from one entry block to the next, the sensing pin is first lowered beneath the log sheet and awaits the next registration hole, the pin being so shaped as to ensure positioning thereof beneath the log sheet. When the next registration hole arrives, the pin is urged upwardly through the hole. At the same time, a brake engaging mechanism is actuated to brake the take-up spool through a bell crank and push rod mechanism and thus maintain the data entry blocks in registry with the imprinting station. An anti-back up device is also provided which prevents back up of the take-up spool as long as a pivotable lid for the recorder is closed. When the lid is opened, the anti-back up device is disabled to permit removal of the processed log sheets from the take-up spool. A tensioning member is also provided for holding the log sheet in place within the recorder even though the trailing edge of the log sheet has left the log sheet supply cartridge.

32 Claims, 19 Drawing Figures

PORTABLE TRANSACTION LOG RECORDER

REFERENCE TO RELATED APPLICATIONS

This application is related to Application Ser. No. 7,637 filed by Morton W. Thomson on Jan. 29, 1979 and to Application Ser. No. 7,638 filed by Heinz F. Strohschneider also on the above date.

BACKGROUND OF THE INVENTION

1. Field of the Invention

This invention relates to portable cassette recorders for use in imprinters and in particular to a recorder of the foregoing type having a supply cartridge, a take-up spool, a brake for the spool and a document holder.

2. Discussion of the Prior Art

As discussed in the above-mentioned related applications, imprinters wherein data from a plurality of different transactions are imprinted on a single transaction log sheet are known. Further, portable cassette recorders for use in such imprinters are also known. The above imprinters and recorders typically employ single transaction log sheets to record the data from the different transactions.

Utilization of such log sheets has been promising because the data from as many as twenty six (for example) different transactions can be recorded onto a single log sheet. This is an improvement over a method currently employed where a separate invoice slip is transmitted to a central processing and billing location for each transaction. That is, in this current method, the invoice employed to record a credit card transaction at a gas station or the like provides three copies of the transaction, one for the customer, one for the dealer and one for the central processing location. However, not only does this method tend to be unwieldy due to the large number of invoices that must be forwarded to the central location but also it is prone to copies of the invoice being lost or damaged due to the large number being handled by the dealer station.

By recording a plurality of different transactions on a single log sheet, the amount of paper and number of sheets that have to be forwarded to the central location can be significantly reduced thereby mitigating the above problems. As stated above, the transaction log sheets employed in the portable cassette recorders of the above-mentioned prior art typically can record twenty six different transactions. Thus, where twenty six different invoice copies are forwarded to the central location in current systems, a single sheet can be forwarded in their place.

However, a shortcoming has arisen with respect to the twenty six entry, transaction log sheets. That is, in order to incorporate twenty six transactions on a single sheet, it is typically necessary to provide a data entry block for each transaction, the width of which extends across the sheet and the height of which is typically ⅜". However, the ⅜" limitation on the height of the data entry block has been unacceptable in certain applications. Thus, it is preferred that the data entry blocks have a height of typically 1". However, when the height of the data entry blocks is increased to 1", the number of blocks per sheet is reduced to about twelve. Although the number of blocks per sheet could be increased back to twenty six by simply increasing the length of the sheet, this introduces further problems because the increased size of the sheet makes it difficult to process it not only in the recorder but in the handling of it by the dealer and central location. However, by reducing the number of transactions to twelve per sheet, the overall purpose of employing a transaction log in the first place is compromised. That is, now one sheet is forwarded to the central processing location in place of twelve items rather than twenty six items.

SUMMARY OF THE INVENTION

It has been determined that the use of fan-folded transaction log sheets will permit the employment of larger transaction data entry blocks having a height of typically 1", for example. Thus, on each of the fan-folded sheets may be provided twelve entry blocks. In accordance with the present invention, the portable cassette recorder thereof may process a plurality of the fan-folded sheets (typically five) whereby sixty transactions would be contained on the five fan-folded sheets. The five fan-folded sheets can be forwarded to the central location as an integral unit for processing and automatic bill preparation. Because the sheets are fan-folded, the size of the integral package lends itself to easy handling. Thus, in effect, the five fan-folded sheets represent a single item which takes the place of sixty separate items of the current method.

It is thus a primary object of this invention to provide a recorder which is particularly suitable for the processing of fan-folded forms or the like.

A particular characteristic of such forms is that the distance from the beginning of a data entry block to the beginning of the next data entry block on a given sheet is different than the distance between the beginning of the last data entry block on a log sheet to the beginning of the first data entry block on the next log sheet. This has not been a problem in the aforementioned prior art devices because only one sheet was loaded into the recorder at a time. Hence, the log sheet advancement means could be arranged to advance the sheet a constant amount when actuated. Such a log advancement means cannot be used in a recorder which processes fan-folded forms. That is, when going from the last entry of one sheet to the first entry of the next sheet, the sheet must be advanced a different distance than the distance it is advanced when going from one data entry block to the next on a particular sheet.

It is accordingly a further object of this invention to provide an improved log sheet advancement mechanism which can advance the log sheets a variable distance yet which ensures that the data entry blocks are maintained in registration with the recorder imprinting station.

It is a further object of this invention to provide an improved log sheet advancement mechanism of the above type wherein a sensing pin is employed to sense registration holes in the log sheet, the sensing pin being so shaped as to ensure accurate advancement of the log sheet.

It is a further object of this invention to provide an improved transaction log recorder having an anti-back up device for the take-up spool, the anti-back up device being actuated when a lid for the recorder is closed and disabled when the lid is opened to permit removal of a processed transaction log therefrom.

It is a further object of this invention to provide an improved recorder of the above type wherein a brake for the take-up spool is actuated by a bell crank and push rod type mechanism.

It is a further object of this invention to provide an improved recorder of the above type wherein the log sheet is held in place within the recorder even though the trailing edge thereof has left the log sheet supply cartridge.

Other objects and advantages of this invention will be apparent from a reading of the following specification and claims taken with the drawing.

DETAILED DESCRIPTION OF PREFERRED EMBODIMENTS OF THE INVENTION

Figure 1:
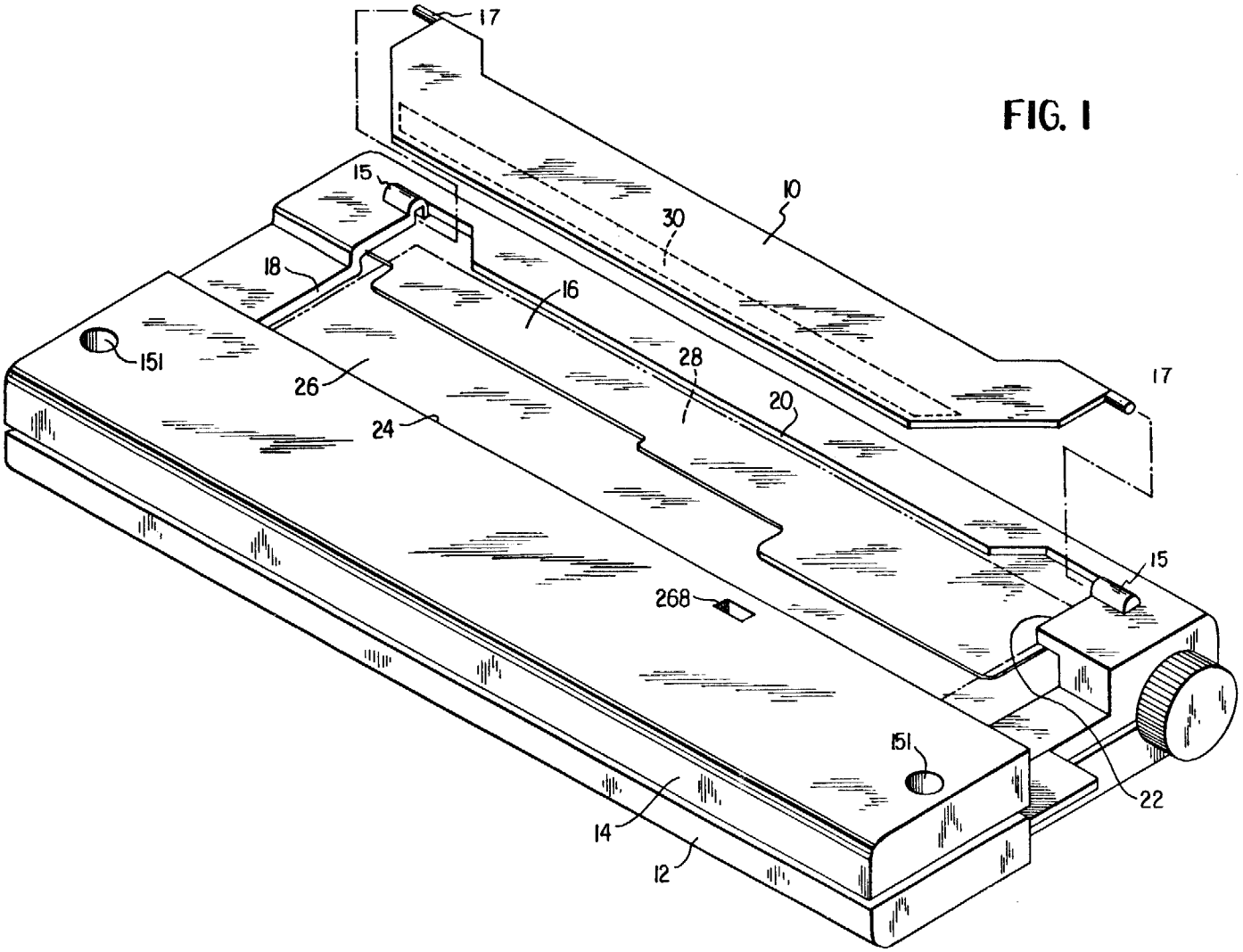
FIG. 1 is a perspective view of an illustrative portable cassette recorder where an illustrative document holder is illustrated in disassembled relation with respect to the recorder.

In FIG. 1, there is shown portable cassette recorder having a document holding cover 10. The recorder includes a base 12 and a lid or cover 14 pivotally mounted with respect to the base and releasably secured thereto by appropriate fastening means, which extend into holes 151. An opening defined by edges 18, 20, 22 and 24 is provided in lid 14. A mask 16 is attached to the inner surface of lid 14 to provide a patterned opening 26 in the lid and to provide a surface upon which an invoice 28 may be positioned, the invoice being indicated by phantom lines. Once the invoice is positioned as shown, cover 10 may be positioned thereover. The cover is pivoted to lid 14 at bearings 15 via pins 17 and includes a strip of magnetic material 30 disposed therein. The magnetic characteristics of mask 16 are such that when cover 10 is positioned over the invoice, the invoice is securely held in place due to the magnetic attraction between magnetic element 30 and mask 16.

Figure 2:
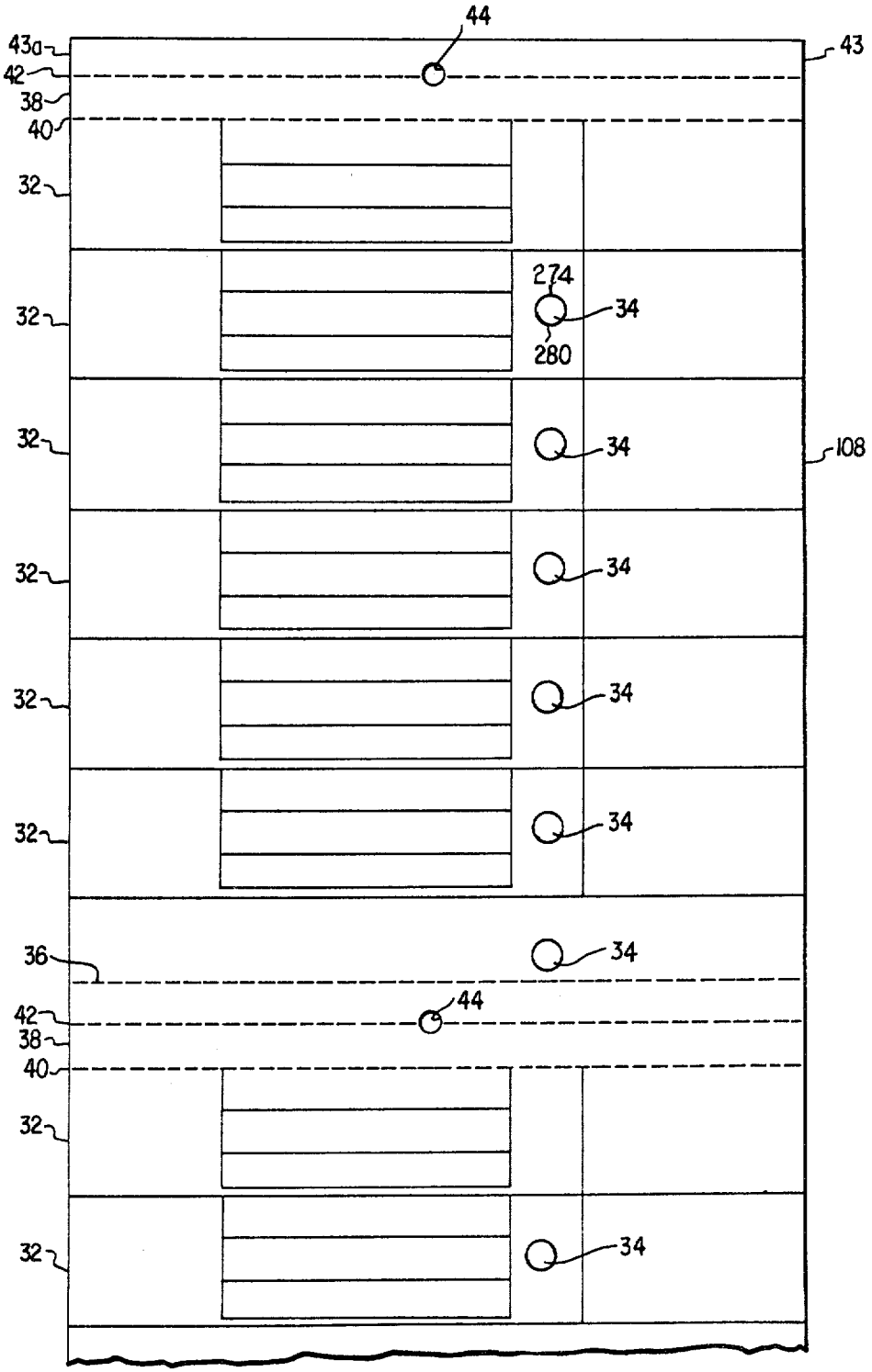
FIG. 2 is a partial plan view of illustrative fan-folded transaction log forms.

In FIG. 2, illustrative fan-fold transaction log sheets are shown. For ease of illustration, only six transaction entry blocks 32 are illustrated per fan-folded sheet. A pin registration hole 34 is associated with each entry block to effect exact registration of the entry blocks within the recorder where each registration hole may be positioned beneath its associated data block, the distance between the holes being equal to the distance between the blocks. The forms are fan-folded at line 36 and at the top of each sheet is provided an entry 38 which contains information the dealer retains, this information being detached from the leading transaction sheet along line 40 prior to the sheets being forwarded to the central processing location. Each sheet is also provided with a perforated fold line 42 to facilitate the attachment of a plurality of the sheets to a leader associated with a take-up spool as will be described hereinafter. To effect proper alignment of the transaction log with the leader, a hole 44 is provided at an approximate central location along line 42 so that the line 42 intersects hole 44.

Figure 3:
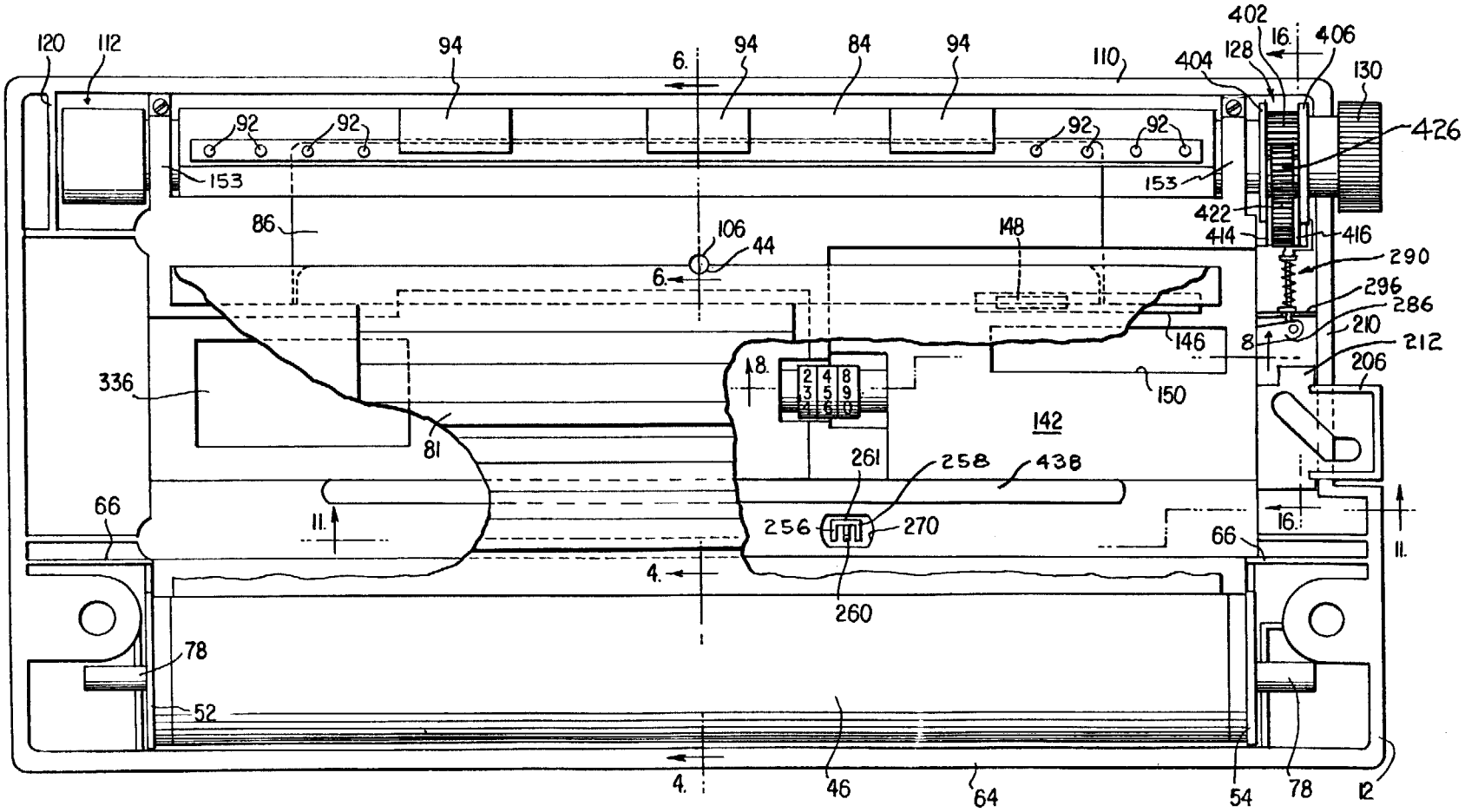
FIG. 3 is a plan view of the base portion of the recorder of FIG. 1 showing a partially illustrated transaction log in place within the recorder.
Figures 4, 5, 6:
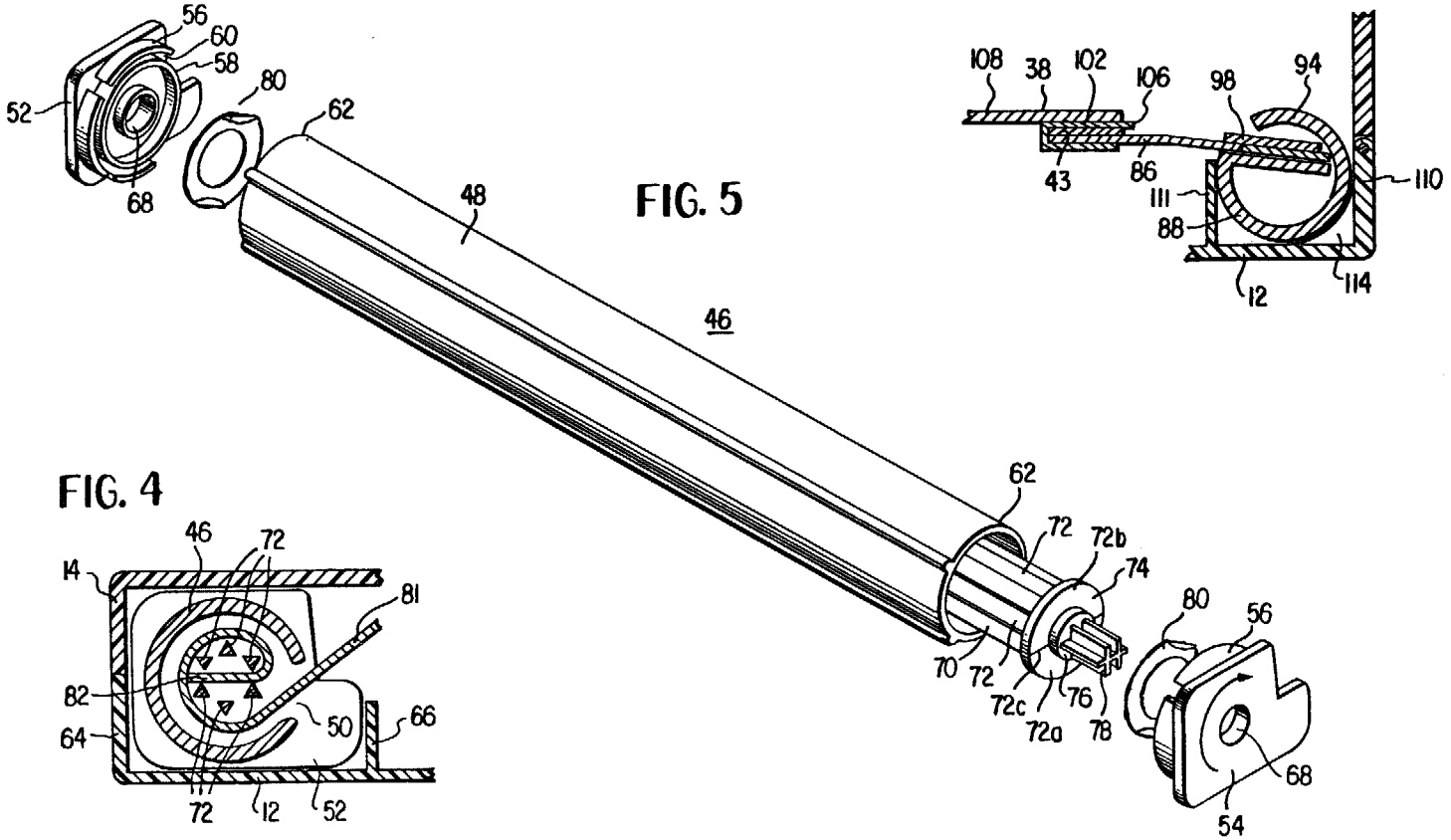
FIG. 4 is a cross-sectional view of an illustrative supply cartridge along the line 4—4 of FIG. 3.
FIG. 5 is a disassembled, perspective view of an illustrative supply cartridge.
FIG. 6 is a cross-sectional view of an illustrative take-up spool along the line 6—6 of FIG. 3.

Referring to FIGS. 3, 4 and 5, there is shown an illustrative supply cartridge 46 in which a plurality of fan-folded forms may be expeditiously loaded. As shown in FIGS. 3 and 4, cartridge 46 is loaded within the forward position of base 12. The cartridge comprises a cylindrical sleeve 48 having a longitudinally extending, elongated opening 50 (see FIG. 4). A pair of end caps 52 and 54 are provided with concentric annular surfaces 56 and 58 whereby the spacing 60 between these surfaces receives the ends 62 of sleeve 48. As can be seen in FIG. 4, end pieces 52 and 54 are so positioned within base 12 to prevent rotation thereof. In particular, the end pieces are positioned between end wall 64 of base 12 and inner wall 66. End pieces 52 and 54 are also provided with bearing bosses 68 which receive the respective ends of a rotatable sheet receiving structure 70. The structure 70 includes a caged spoke section comprising a plurality of elongated spokes 72 which extend between end pieces 74. A hub 76 is attached to each end piece and an extension 78 is attached to each hub. The hubs 76 are mounted within bearings 68 of end plates 52 and 54 and the extensions 78 extend beyond the plates as shown in FIG. 3. A pair of annular compression springs 80 are disposed within the end plates 52 and in particular in the annular recesses provided between surfaces 58 and bearings 68. The springs 80 bear against the end pieces 74 of sheet receiving member 70 to prevent spring-back of the fan-folded sheets as they are wound into cartridge 46.

Loading of a plurality of fan-folded sheets is effected in a straightforward manner. The bottom edge (see line 36 of FIG. 2) of the first sheet 81 to be loaded in the cartridge is inserted between the spokes 72 as shown in FIG. 4, the bottom edge being indicated at 82. Since there are a plurality of spokes, it makes no difference what the angular orientation of the spokes is when loading of the sheets is initiated, since the sheet edge 82 may be fitted between any adjacent pairs of spokes. Once the sheet is inserted, one of the extensions 78 may be clockwise rotated as indicated in FIG. 5 to wind the fan-folded forms into the cartridge. In the foregoing manner, a plurality of such fan-folded forms can be loaded. Typically, the operator simply counts off a required number (typically five) of forms from a fan-folded stock of the forms and tears off the forms to be loaded in the cartridge. Due to the inherent springiness of the forms, there is a tendency for the loaded forms to immediately unwind as soon as the operator removes his hand from extension 78. This is avoided by springs 80 which provide sufficient frictional pressure on the outer surfaces of end pieces 74 to prevent such spring-back of the forms.

A further feature of supply cartridge 46 is the fact that the form receiving member 70 may comprise two halves 72*a* and 72*b*. One of the hubs 76 and extension 78 is associated with 72*a* as are three of the spokes 72. The other hub 76 and extension 78 are associated with member 72*b* as are the other three spokes 72. Hence, sheet receiving member 70 can be readily fabricated by simply cementing together the halves thereof, the division between the halves being indicated by line 72*c*. Further, the remaining elements of cartridge 46 are also easily and economically fabricated. Hence, the resulting cartridge can be economically produced in large quantities. Since cartridge 46 is intended to be a replaceable item, such economy of manufacture is, of course, advantageous. Thus, it is possible to provide a dealer with a number of the cartridges whereby he may load them with the requisite number of fan-folded sheets and store them in an appropriate place. Thus, whenever a cartridge is required for use, it may be simply removed from its storage place and inserted within the recorder as shown in FIG. 4. Hence, loaded, supply cartridges will always be available during busy times.

Figure 7:
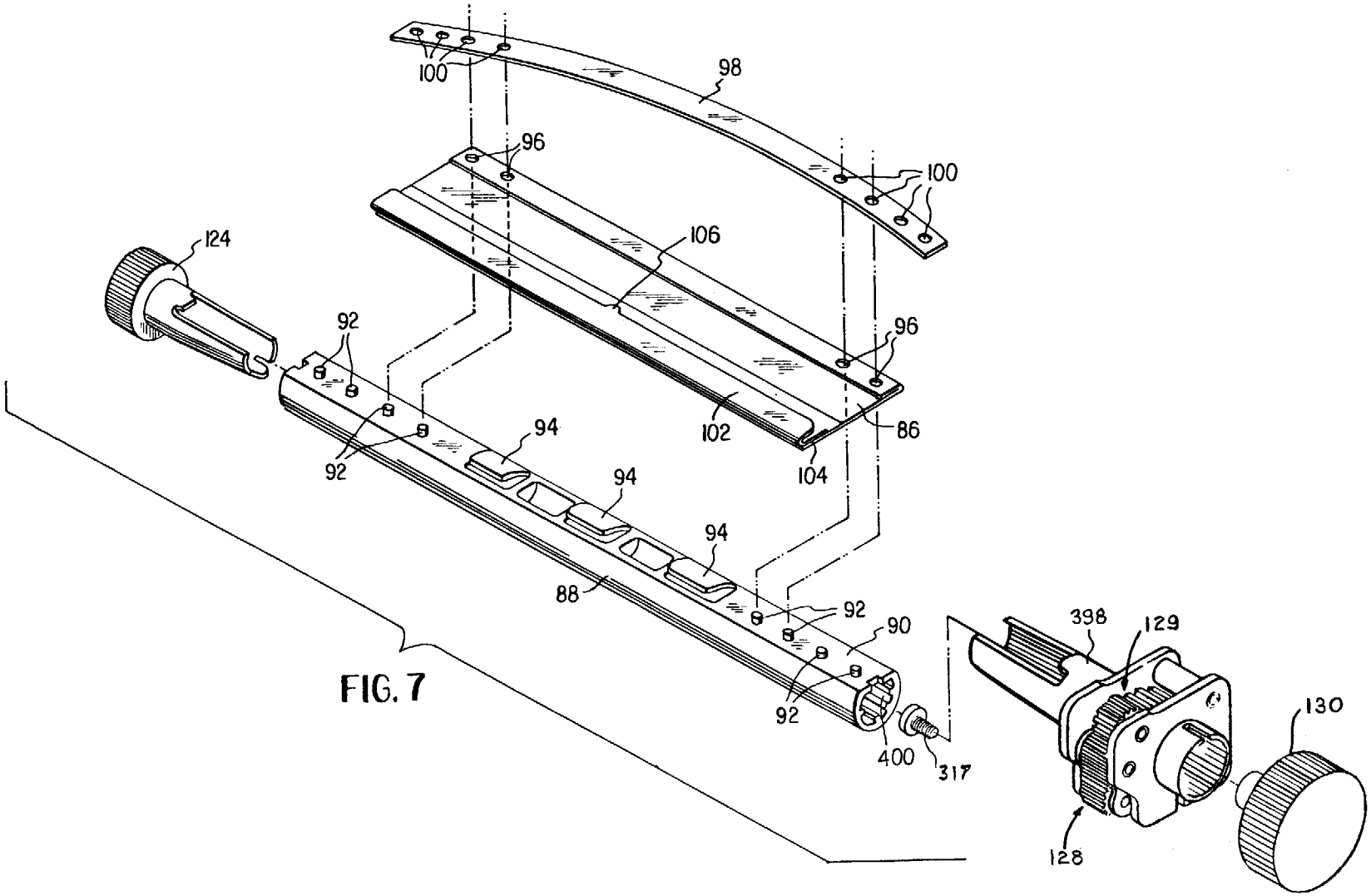
FIG. 7 is a disassembled, perspective view of an illustrative take-up spool.

Reference should now be made to FIGS. 6 and 7 which show an illustrative take-up spool 84 which is provided with a leader 86 which is adapted to receive the fan-folded sheets. Hence, it is not necessary to provide such leaders on the sheets themselves whereby the sheets may be more efficiently utilized to record transaction information. As can best be seen in FIG. 7, spool 84 comprises a cylindrical member 88 having a planar, chordal surface 90. Stubs 92 are disposed at opposite ends of member 88. A plurality of leader receiving recesses 94 are centrally located along chordal surface 90. Leader 86 is provided with a plurality of holes 96 at the rearward sides thereof, the leader being attached to cylindrical member 88 by placement of the holes 96 over the inner two stubs 92 at the respective sides of the leader, as indicated in FIG. 7. A strip 98 having four holes 100 at each end thereof is employed to secure the leader in place on cylindrical member 88. Thus, as can be seen in FIGS. 6 and 7, after holes 96 have been placed over the inner two stubs 92, strip 98 is positioned over the rearward end of the leader. In particular, holes 100 are placed over the stubs 92 while the central portion of strip 98 is positioned within the recesses formed by members 94 over the central, rearward portion of leader 86 to thereby effect a secure attachment of the leader to cylindrical member 88.

Leader 86 is preferably flexible and is provided with a relatively rigid forwardly disposed lip 102 which forms an elongated, longitudinally extending recess 104. Further, lip 102 is provided with a centrally disposed projection 106 to facilitate alignment of the transaction logs with respect to the take-up spool. The first of the fan-folded sheets 108 (see FIGS. 2 and 6) is connected to the leader 86 in the following manner. The sheet is folded along line 42 so that portion 43 is underneath portion 38. The left edge 43*a* (or right edge) is then inserted into the right edge (or left edge) of recess 104 and slid within the recess until hole 44 is aligned with projection 106. The projection is then inserted through hole 44 whereby attachment of sheet 108 to leader 86 is effected and whereby alignment of sheet 108 with respect to the spool is also effected due to the central location of hole 44 with respect to sheet 108 and the central location of projection 106 with respect to cylindrical member 88.

As can be seen in FIGS. 3 and 6, the take-up spool is mounted in the rearward end of base 12 between rear wall 110 and inner wall 111. A plurality of ribs 114 (see FIG. 12) may be provided along wall 110 to provide a receiving surface which conforms to the cylindrical surface of member 88.

As can be seen in FIG. 7, a support member 124 is connected to one end of cylindrical member 88 while disposed at the opposite end of member 88 is a brake mechanism generally indicated at 128, an anti-backup mechanism at 129 and a turning knob 130. As will be discussed in detail hereinafter, knob 130 is employed to advance the transaction log from one transaction entry block to the next, brake 128 is employed to (a) prevent advancement of the log except when necessary to advance it and (b) maintain the log accurately registered in the recorder, and anti-backup mechanism 129 is employed to prevent backup of the log except when removing it from the take-up spool.

Reference should now be made to FIGS. 3, 8, 9, 10 and 12 which show an illustrative frame 132 which is secured to base 12 via (a) mounting screws 134 through openings 136 in base 12 and threaded holes 138 in frame 132 and (b) screws 135 through openings 137 in frame 132 and threaded holes 139 in base 12. Arms 153 (see FIGS. 3 and 10) of frame 132 hold rotatable spool 84 in place on the base. Frame 132 includes a slidable, card receiving tray 140, which is slidable between a non-latched, card receiving position (see FIG. 9) and a latched, imprinting position (see FIGS. 8 and 10). Card tray 140 is described in U.S. Pat. Nos. 3,945,316 and 3,983,802, which are incorporated herein by reference. As described in these patents, frame 132 is provided with an inclined upper surface 142 (FIG. 8) which mates with an inclined lower surface 144 of tray 140. A slot 146 in surface 142 is provided with a spring 148 which normally biases tray 140 to its non-latched, card receiving position. In order to slide tray 140 with respect to surface 142, a slot 150 is provided in surface 142 and a projection 152 is provided on the lower surface of tray 140, projection 152 sliding within slot 150. The tray 140 is also provided with a card receiving recess 154.

Figure 8:
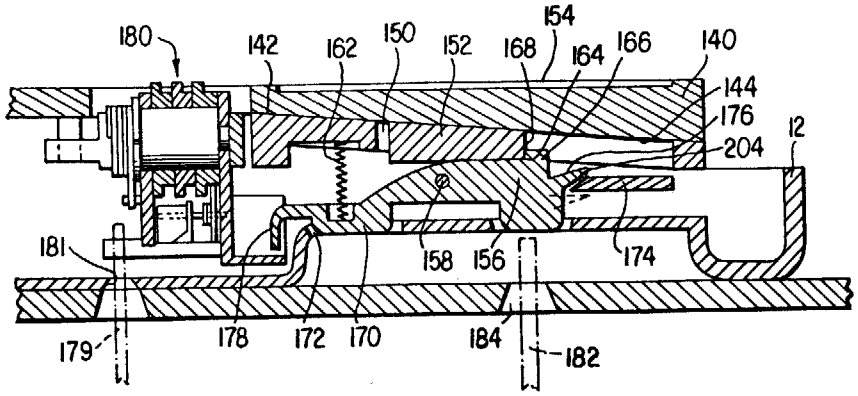
FIG. 8 is a cross-sectional view of an illustrative card receiving tray and latch therefor taken along the line 8—8 of FIG. 3.
Figure 10:
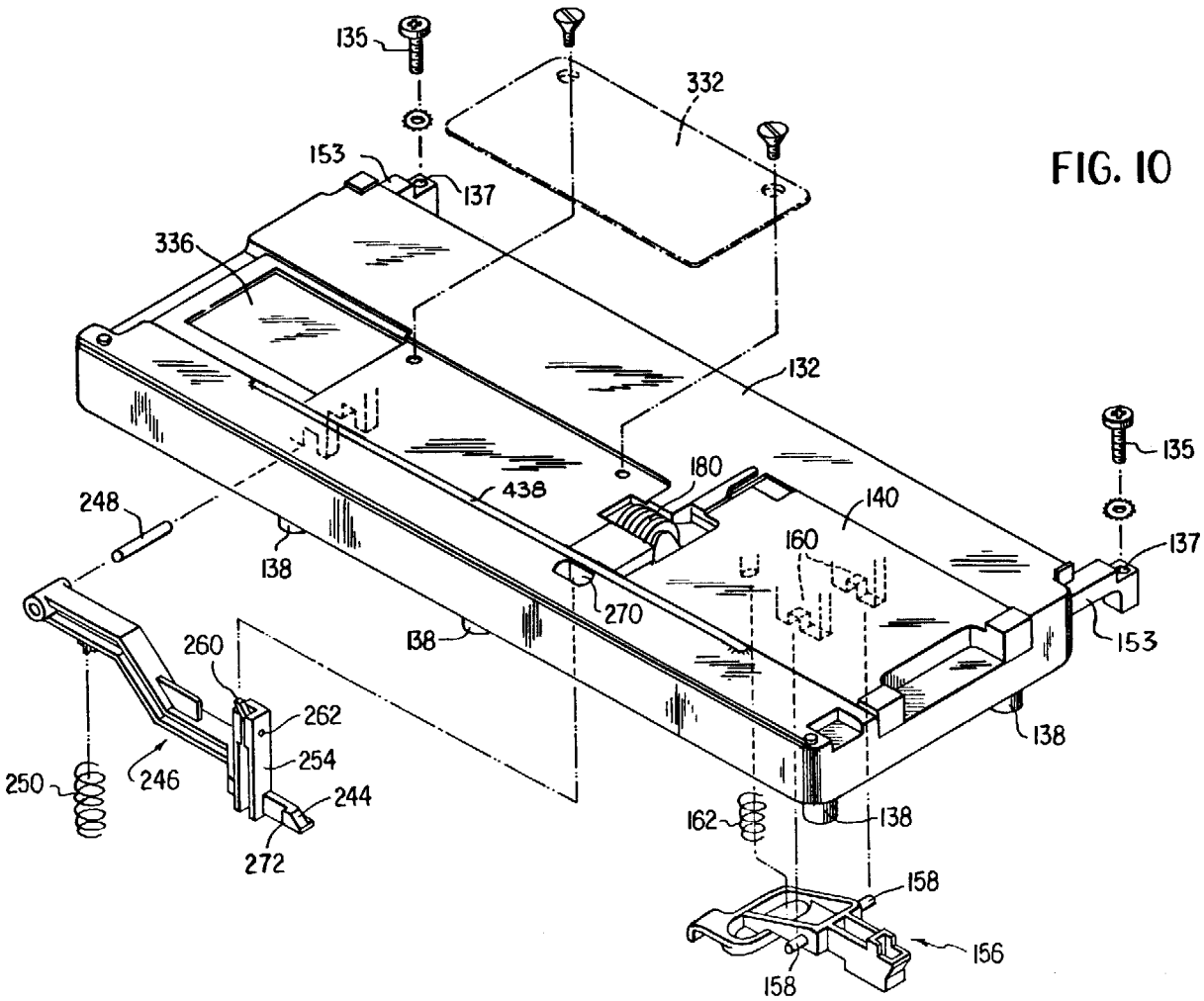
FIG. 10 is a disassembled, perspective view of an illustrative imprinting station frame.

In FIG. 8, the tray is shown in its latched position, this being effected by a latch member 156 which is pivotally mounted at 158 by a pair of rods disposed within bearings 160 (see FIG. 10). The latch 156 is normally biased in a counterclockwise direction by spring 162. In the latching position shown in FIG. 8, a latch point 164 is provided between a ledge 166 of latch 156 and the forward edge 168 of projection 152. Hence, until the latch is disabled, the card receiving tray 140 will remain in the imprinting position shown in FIGS. 8 and 10.

Latch 156 may be disabled in either of two ways. First, a button 170, which extends through an opening 172 in base 12 may be manually depressed thereby compressing spring 162 and clockwise rotating latch 156. As soon as ledge 166 moves below projection 168, spring 148 will return tray 140 to its card receiving position. At this time the credit card or the like may be removed. However, another card cannot be inserted into the recorder because of a latch override plate 174 which will be discussed in more detail hereinafter with respect to FIG. 9. For the present, it can be seen in FIG. 8 that plate 174 maintains a finger 176 of latch 156 in a lowered, dotted line position thereby overriding the latch as long as plate 174 is in the illustrated position.

The latch 156 may also be disabled by its co-action via a finger 178 with a transaction counter generally indicated at 180. This co-action has been described in detail in U.S. Pat. No. 3,987,802 (FIG. 6) and forms no part of the present invention. Also described in the foregoing patent is an optional sensing lever 182 which projects through an opening 184 in the imprinter base to sense whether a card has been inserted into the recorder. If not, imprinting is prevented.

Figure 9:
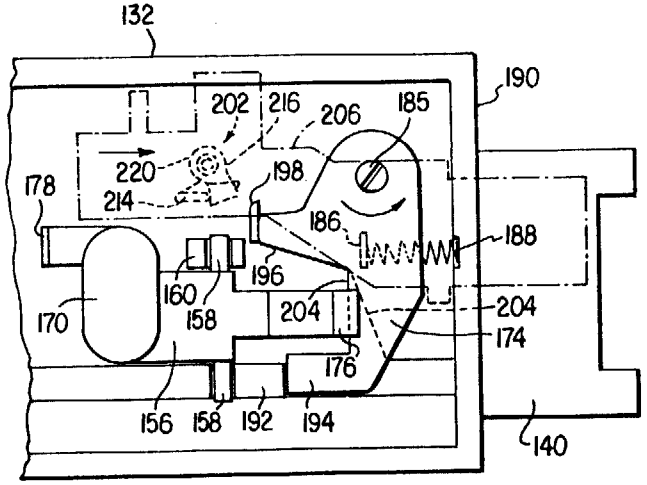
FIG. 9 is a bottom plan view of the latch of FIG. 8 together with an illustrative latch disable plate.

In FIG. 9, there is illustrated a bottom plan view of latch 156 in its non-latching position. It is maintained in this position by plate 174. As long as the plate is in the position shown in FIG. 9, card receiving tray 140 cannot be latched to its imprinting position. Plate 174 is pivotally mounted about a screw 185 which is connected to the underside of frame 132 and includes an upwardly extending projection 186. A compression spring disposed between projection 186 and a recess 188 in the sidewall 190 normally biases plate 174 in the clockwise direction in FIG. 9. A post 192 depending from the underside of frame 132 engages an arm 194 of plate 174 to limit the clockwise rotation of the plate. Plate 174 is provided with another arm 196 having a shoulder 198 at the end thereof. As will be explained in more detail hereinafter, shoulder 198 is in the path of travel of a slide 206 (indicated in phantom lines). When the slide moves in the direction of the arrow, a plate release mechanism indicated at 202 engages shoulder 198 to thereby compress spring 188 and rotate plate 174 in the illustrated counterclockwise direction. Edge 204 is thus rotated to the illustrated dotted line position whereby finger 176 moves out of engagement with edge 204. Thus, as can best be seen in FIG. 8, latch 156 is then rotated under the influence of spring 162 to its solid line position. The card tray 140 may thus again be moved from its extended position shown in FIG. 9 to its latched position shown in FIG. 8.

Reference should now be made to FIGS. 10–14 which show illustrative means for ensuring that advancement of the log transaction sheets is from one transaction entry block to the next. In FIGS. 1 and 10–12, there is illustrated a slide 206 which extends through a slot 208 in a sidewall 210 of base 12. Slide 206 is provided with a projection 212, the purpose of this projection being to facilitate the actuation of brake 128 as will be explained in more detail hereinafter. Slide 206 also includes plate release mechanism 202 discussed hereinbefore with respect to the actuation of plate 174. Mechanism 202 includes a projection 214 extending from the upper surface of slide 206 together with a lever 216 which is pivotally mounted on slide 206 about a post 218. A spring 220 disposed about post 218 normally biases lever 216 against projection 214. Thus, in FIG. 9 when slide 206 moves in the direction of the arrow, the lever 216 will be pressed against projection 214 as it passes shoulder 198 of plate 174 to thereby effect counterclockwise rotation of the plate. However, when slide 206 is moved in the direction opposite the arrow, the lever 216 will be rotated away from projection 214 thus permitting the plate release mechanism 202 to pass shoulder 198 without affecting plate 174.

Slide 206 also includes downwardly depending extension 222. As can best be seen in FIGS. 11 and 12, a compression spring 224 engages extension 222 and an end wall 226 to normally bias slide 206 outwardly from base 12. The slide is shown in this extended position in FIG. 11. Slide 206 is also provided with a downwardly extending mounting plate 228 which has extending therefrom a rest 230 and a post 232. An interposer 234 is pivotally mounted on post 232 and clockwise biased by a spring 236 so that a rear arm 238 rests on the upper surface of rest 230. A forward arm 240 of interposer 234 includes a cam follower roller 241 mounted on a pin 242.

Figure 11:
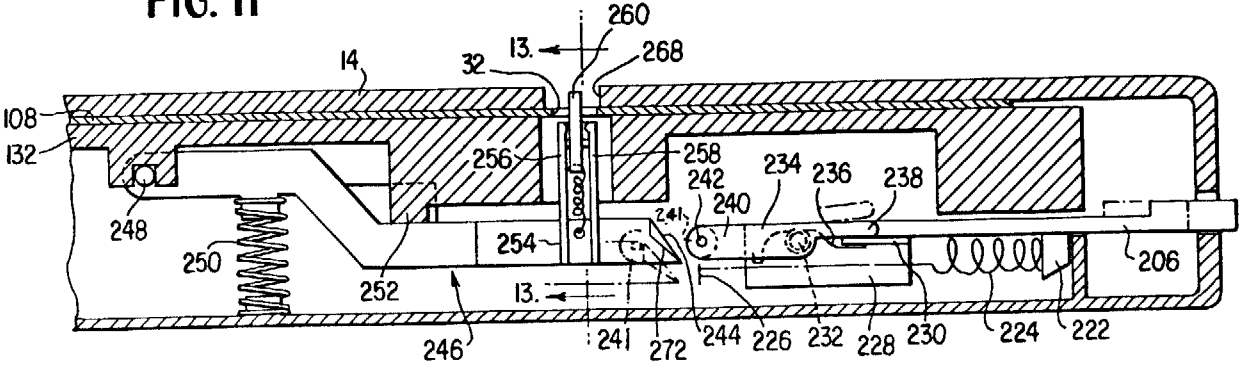
FIG. 11 is a cross-sectional view of an illustrative registration hole sensing pin mechanism taken along the line 11—11 of FIG. 3.

Roller 241 co-acts with cam surface 244 of a plunger mechanism generally indicated at 246 in FIGS. 10 and 11. The plunger is pivotally mounted with respect to the lower surface of frame 132 by a pin 248. A spring 250 normally biases the plunger in the counterclockwise direction. A post 252 depending from the lower surface of frame 132 limits the counterclockwise rotation of the plunger. The plunger is provided with a sensing pin mounting member 254. Member 254 comprises a U-shaped, elongated channel member having legs 256 and 258 and base 261 as can best be seen in FIGS. 3 and 13. Rotatably mounted within member 254 is a registration hole sensing pin 260. Pin 260 is mounted on a rod 262 which extends between the legs 256 and 258. A spring 264 normally counterclockwise biases pin 260, the spring being connected between one end of the pin and a hole 266 in base 261.

Figure 13:
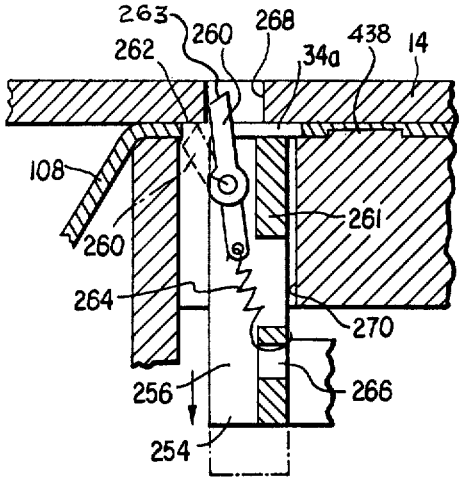
FIG. 13 is a cross-sectional view of the sensing pin taken along the line 13—13 of FIG. 11.

Sensing pin mounting member 254 is normally upwardly biased by spring 250 through a hole 270 which extends through the upper surface of frame 132 as can be seen in FIGS. 3, 10 and 13. During an imprinting operation, pin 260 also extends through registration hole 34*a* in transaction log sheet 108 as shown in FIG. 13. It further extends into an opening 268 in the lid 14 as shown in FIGS. 1, 11 and 13. In order to advance log sheet 108 from one transaction entry block to the next, sensing pin 260 must be lowered beneath registration hole 34*a* and sheet 108. This is effected by lowering mounting member 254 to the dotted line position shown in FIGS. 11 and 13. The lowering of mounting member 254 is effected by the co-action of slide 206 with plunger 246. When slide 206 is manually depressed to the left to the dotted line position shown in FIG. 11, the follower roller 241 of interposer 240 will engage cam surface 244 of the plunger and push the plunger down until the plunger reaches the illustrated dotted line position. When roller 241 reaches the illustrated dotted line position behind cam surface 244, it will remain there until sensing pin 260 senses the next registration hole on sheet 108. The foregoing results from the fact that when sensing pin 260 is brought below the level of registration hole 34*a*, it is rotated to the dotted line position shown in FIG. 13 beneath lid 14 by spring 264. As will be described below, the pin will slide below the log as the log is advanced due to the angle of the taper 263 provided at the end of the pin. The pin will then remain beneath the log sheet until the next registration hole 34*b* (FIG. 14) is advanced to it. Hence, as long as pin 260 is beneath the log sheet, plunger 246 will be depressed and, as long as the plunger is depressed, follower roller 241 cannot return to the front of cam surface 244. When the next registration hole 34*b* reaches sensing pin 260, the pin is immediately inserted through the hole under the influence of spring 250 to raise plunger 246 and return the sensing pin to its solid line position of FIG. 13. As plunger 246 rises to its solid line position, roller 241 rides down surface 272 behind cam surface 244 and is then returned to its solid line position shown in FIG. 11 under the influence of spring 224.

Figure 14:
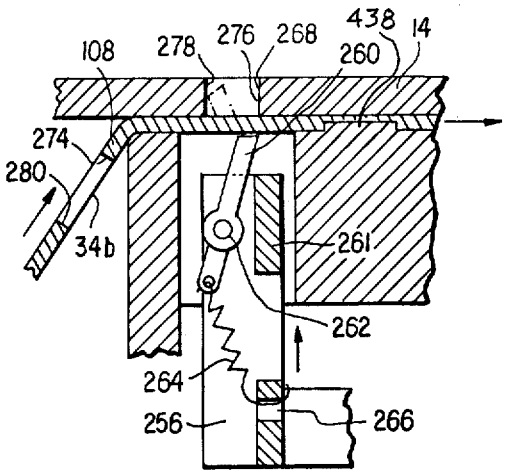
FIG. 14 illustrates the sensing pin of FIG. 13 in its lowered position awaiting the arrival of the next registration hole in the transaction log sheet.

Reference should be made to FIGS. 13 and 14 which illustrate the co-action of sensing pin 260 with registration holes 34 to minimize, if not avoid, damage to the registration holes by the sensing pin. It is important that these holes not be damaged since the transaction logs are typically processed by other document handling equipment. As stated above, pin 260 is lowered to its dotted line position beneath lid 14 upon depression of slide 206. At this time, brake 128 is released as will be described hereinafter whereby the log sheet can be advanced. As the sheet is advanced, pin 260 slides beneath sheet 108 because the taper 263 of pin 260 is such that the log sheet can slide between the lid and the pin with little, if any, rotation of the pin. Once the pin is beneath the sheet, the pin is rotated from its dotted line position shown in FIG. 13 to its solid line position shown in FIG. 14 due to continued advancement of the log sheet. This rotation results from the fact that pin 260 is pushed against sheet 108 by spring 250 (see FIG. 11). Thus, as log sheet 108 slides by pin 260, the pin is rotated to its solid line position shown in FIG. 14. There it awaits the next registration hole 34*b*. In the aforementioned related application, the holes 34 (see FIG. 2) are preferably provided with straight upper edges. In the present invention, the holes may have straight upper edges or they may be completely round. Regardless of the hole shape the sensing pin registration mechanism of the present invention will reliably operate due to the taper 263 of the sensing pin as discussed above. Thus, accurate registration of the data entry blocks with respect to imprinting station is ensured in spite of paper tracking error.

When top edge 274 of hole 34*b* (see FIGS. 2 and 14) contacts pin 260, the pin will be urged upwardly under the influence of spring 250 while at the same time it will be forwardly rotated in a counterclockwise direction under the influence of spring 264 so that its final position is indicated by the dotted lines in FIG. 14. Because of the forward rotation of pin 260 away from edge 274 of the registration hole, there is little, if any, danger that the edge will be damaged as pin 260 is upwardly urged by spring 250. Further, the width of hole 268 in lid 14 from edge 276 to edge 278 is preferably less than the width of the holes 34 from edge 274 to bottom 280. Hence, since pin 260 comes to rest against edge 278 of hole 268 as shown in FIG. 14 and since the take-up spool 84 is braked (as will be described hereinafter), when the sensing finger is raised through hole 34*b*, the finger 260 will tend not to immediately engage the bottom edge 280 of the hole. Thus, damage to the bottom of the hole by finger 260 is also avoided.

It should be understood that although several of the above features have been described as being preferable, certain ones of these features may be varied or eliminated. Thus, for example, registration holes of arbitrary shape may be employed. Further, although preferably employed with fan-folded forms, the registration hole sensing arrangement may also be employed with other forms.

As indicated hereinbefore, a further aspect of the invention resides in the fact that credit card receiving tray 140 cannot be latched in its imprinting position until log sheet 108 has been advanced from one transaction entry block to the next—that is, from one registration hole 34 to the next. Thus, at the end of each transaction (or imprinting cycle), card tray 140 is ejected from the recorder either automatically under the control of finger 179 or manually by depressing button 170 of latch 156 as discussed with respect to FIG. 8. Once the latch is disabled in the foregoing manner, it is maintained in its disabled state by latch 174 as discussed hereinbefore with respect to FIGS. 8 and 9. With the latch in its thus disabled state, the operator removes the credit card from the ejected tray 140 so that it may be returned to the customer.

In order to remove the disable (or interlock) from latch 156 so that a next customer's card may be inserted into the recorder and latched into position by latch 156, it is necessary that the operator advance the log transaction sheet to the next data entry block and thereby avoid inadvertent imprinting of the next transaction over the previous transaction data on the log sheet. However, as will be brought out hereinafter, the log sheet cannot be advanced as long as slide 206 is in its extended position shown in FIG. 3. When the slide is depressed into the recorder, brake 128 on take-up spool 84 is removed and the sensing pin 260 is positioned below the transaction log as discussed hereinbefore with respect to FIG. 13. Thus, the log may be advanced to its next data entry block.

However, if the operator does not completely advance the log sheet to the next block, it will still not be possible to insert the next customer's credit card into the recorder. As discussed hereinbefore with respect to FIG. 9, when slide 206 is depressed, plate release mechanism 202 which disengages plate 174 from latch 156 is not affected. Only when the plate 206 is returned to its extended position is plate 174 rotated to remove the interlock on latch 156. Since plate 206 will not be returned to its extended position by spring 224 until the log has been completely moved to the next transaction block, it can be seen from the foregoing that it will not be possible to latch card tray 140 at its imprinting position until the log has been completely advanced to the next block.

Figure 12:
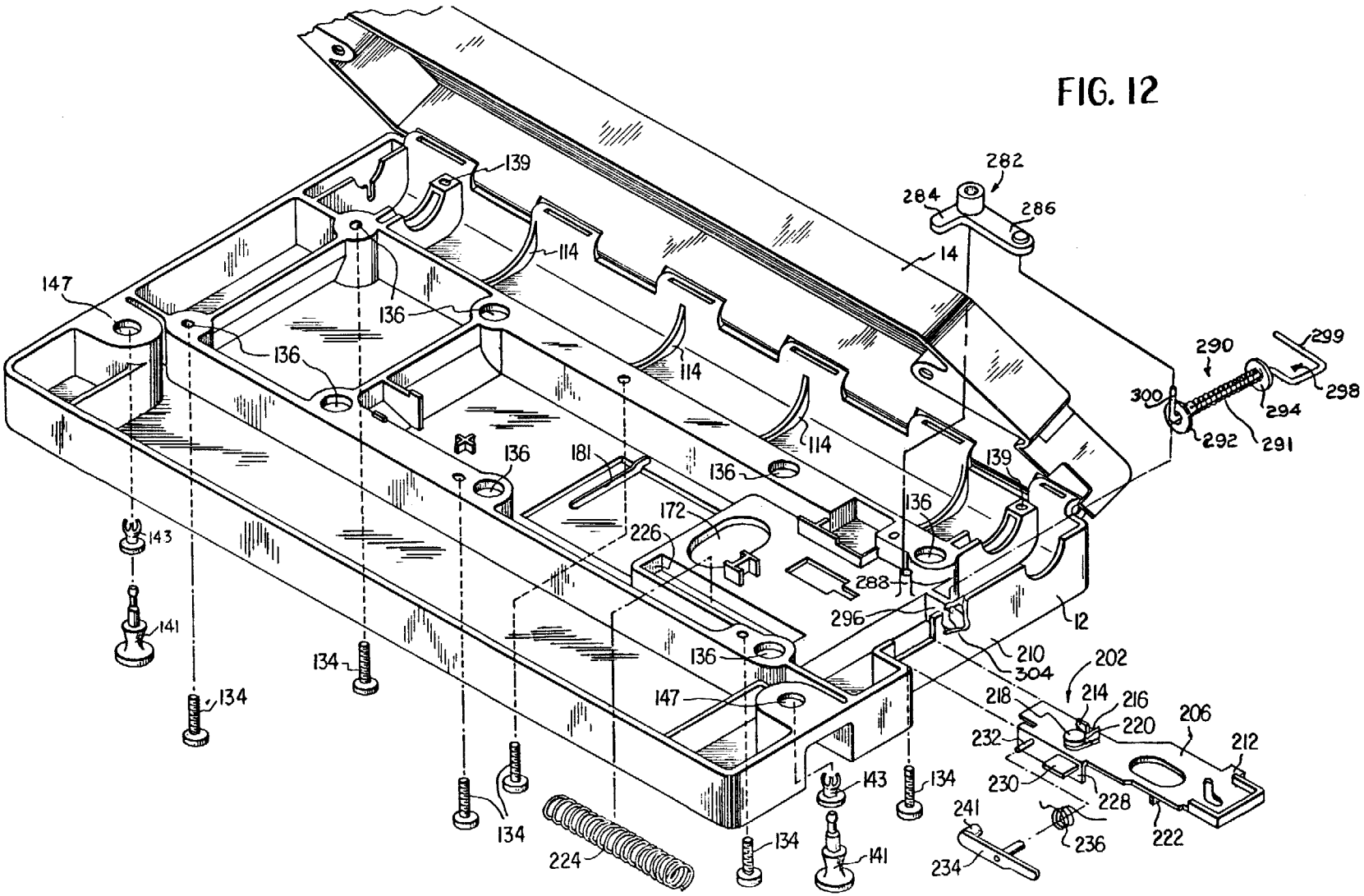
FIG. 12 is a disassembled, perspective view of the base and lid of the recorder of FIG. 1.
Figure 15:
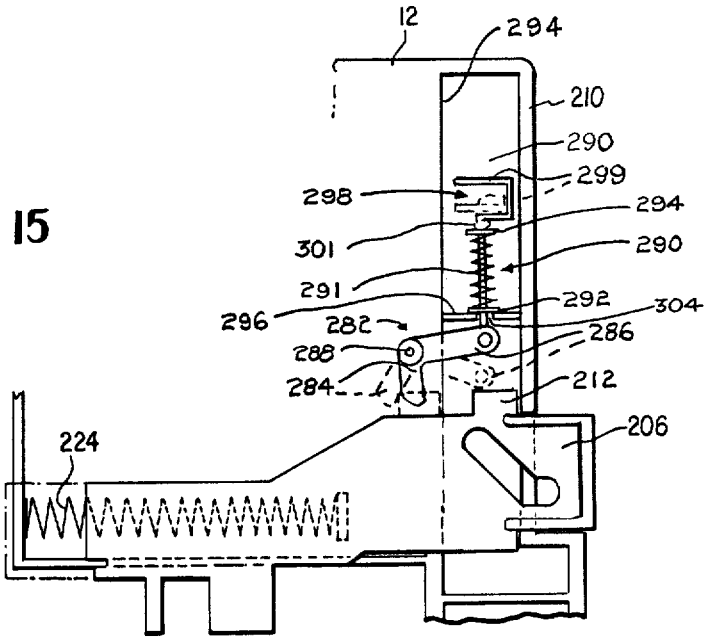
FIG. 15 is a plan view of an illustrative sensing pin and brake actuating mechanism.
Figure 16:
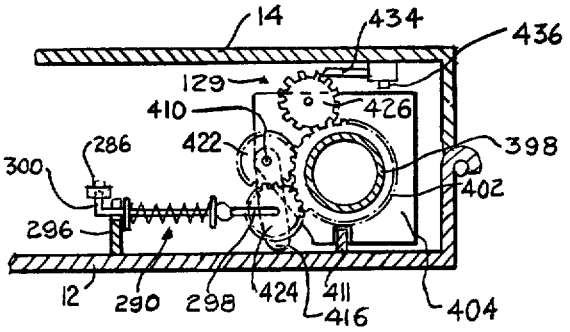
FIG. 16 is a cross-sectional view of an illustrative brake for the take-up spool taken along the line 16—16 of FIG. 3.
Figure 17:
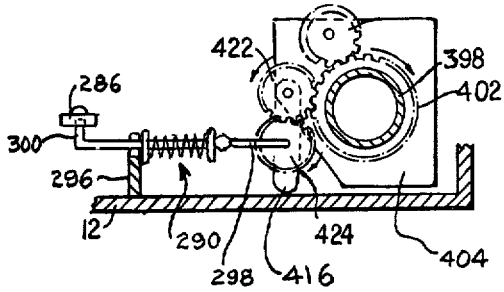
FIG. 17 illustrates the brake of FIG. 16 in its disengaged state.

In order to prevent the operator from moving the transaction log beyond the imprinting station, brake mechanism 128 is actuated in response to the direction of the next registration hole 34*b* by sensing pin 260 as can best be seen in FIGS. 15–17. In FIGS. 15 and 16, slide 206 is shown in its extended position. As can be seen in FIGS. 12 and 16, a bell crank 282 is provided having arms 284 and 286, the crank being rotatably mounted on a post 288 provided on base 12. The crank cooperates with a push rod generally indicated at 290, the push rod being generally disposed within a channel 290 formed in base 12 between sidewall 210 and an interior wall 294. The push rod is biased upwardly in FIG. 15 by a compression spring 291 concentrically mounted thereon, the spring being disposed between two washers 292 and 294 also mounted on the push rod. Washer 292 is pressed against a wall 296 while washer 294 is pressed against a stop 301 formed on the rod, the stop being adjacent a bent portion of the rod generally indicated at 298 where the bent portion includes an arm 299. The push rod is also bent upwardly at 300 (FIG. 12), the portion 300 extending into a hole 302 (not shown) provided in the underside of bell crank arm 286. A slot 304 is provided in wall 296 to facilitate the holding in place of the push rod. Thus, when slide 206 is depressed into the recorder and latched there by plunger 246 (FIG. 11), push rod 290 is moved downwardly in FIG. 15 due to counterclockwise rotation of bell crank 282 by projection 212 so that arm 299 of bent portion 298 assumes and maintains the dotted line position shown in FIG. 15 and the position shown in FIG. 17 as long as slide 206 is depressed.

A pair of brackets 416 and 418 of brake mechanism 128 are connected to arm 299 of bent portion 298 and are moved between the position shown in FIG. 17 (brake disengaged) and the position shown in FIG. 16 (brake engaged). Reference should be made to FIGS. 3, 7, 15, 17 and 18 regarding brake mechanism 128. The brake includes an end piece 398 (see FIG. 7) which is friction fit into open end 400 of cylindrical member 88. As can best be seen in FIG. 18, integrally connected to end member 398 is a gear 402. Mounted on member 398 are a pair of end plates 404 and 406 disposed on opposite sides of gear 402. The plates are notched at 408, the notches fitting over a projection 411 (see FIG. 16) which upwardly extends from base 12 to thereby prevent rotation of the plates with respect to the base. A slot 407 is provided at one end of member 398 and a tang (not shown) in the interior of knob 130 is keyed in the slot to provide clockwise rotation of the take-up spool 84 upon rotation of knob 130 and thereby advancement of the log sheet. As stated hereinbefore, counterclockwise rotation of knob 130 is prevented by anti-backup device 129.

Three rods 410, 412 and 413 extend between plates 404 and 406. Pivotally mounted on rod 410 are bracket pair 414 and 416. Disposed between brackets 414 and 416 are a pair of gears 422 and 424, gear 422 being mounted on rod 410 and gear 424 being mounted on a tubular pin 426 connected between brackets 414 and 416 where arm 299 of push rod 290 extends through pin 426. Normally both gears 422 and 424 are biased into engagement with gear 402 by push rod 290 as can best be seen in FIG. 16.

When push rod 290 is moved to the left in FIG. 17 (upon slide 206 being depressed, as described hereinbefore), brackets 414 and 416 are clockwise rotated to thereby disengage gear 424 from gear 402. In this condition, the brake is disengaged and member 398 (and take-up spool 84) may be clockwise rotated as indicated in FIG. 17. Because of the rotation of gear 402, gear 422 will counterclockwise rotate and gear 424 will clockwise rotate.

It is because gear 424 tends to rotate in the clockwise direction that the brake becomes effective when both gears 422 and 424 engage gear 402 as shown in FIG. 16. In this position the push rod extends to the right (slide 206 extended) and the brake is engaged because the direction of rotation of gear 424 opposes the direction of rotation of gear 402.

Hence, there is provided a straightforward braking mechanism which is responsive to the position of slide 206. In particular, slide 206 will be ejected as soon as the operator moves the transaction log to the next data entry block as defined by the next registration hole. With the ejection of slide 206, the brake is engaged as shown in FIG. 16 and thus, the operator cannot move the log any further. Further, the log is maintained in place during the subsequent imprinting cycle. However, as long as slide 206 is depressed thereby dropping sensing finger 260 beyond log sheet 108, the log can be readily advanced due to the disengagement of the brake as indicated in FIG. 17.

Figure 18:
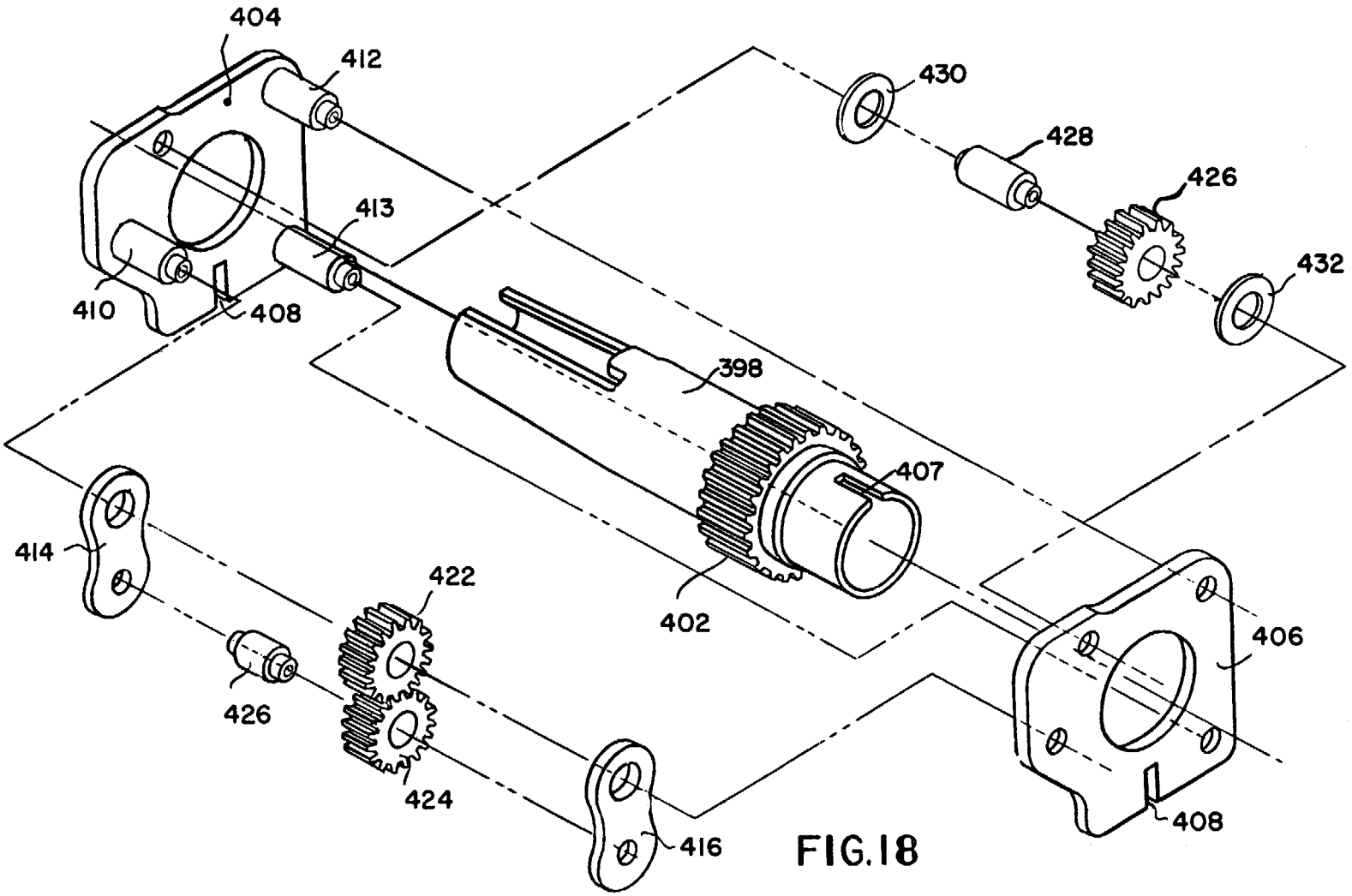
FIG. 18 is a disassembled, perspective view of the brake of FIG. 16.

To prevent backing up of take-up spool 84, a rotatable gear 426 engages gear 402, gear 426 being mounted on a pin 428 which extends between plates 404 and 406 and washers 430 and 432 as shown in FIG. 18. As indicated in FIG. 16, a pawl 434 is mounted on the underside of lid 14 via pin 436 so that when the lid is closed onto the base the pawl prevents clockwise rotation of gear 426 and thus counterclockwise rotation of gear 402. Accordingly, back up of the take-up spool is prevented when the lid is closed. When the lid 14 is pivoted away from the base, the pawl is disengaged from gear 426. Thus, the take-up spool may then be backed up to effect removal of the log from the spool.

As the last few entry blocks of the last log sheet are being recorded upon, the end of the log sheet will disengage from supply cartridge 46. In order to maintain the log sheet in place during imprinting of the last few entry blocks, a ridge 438 is provided on frame 132 as shown in FIGS. 10 and 14, the clearance between the underside of lid 14 and ridge 438 being such that the log sheet will be tensioned as the last few entry blocks are imprinted. Thus, more entry blocks per sheet can be utilized. Further, by positioning the ridge subsequent to the sensing pin and preferably adjacent thereto, the last registration holes can be sensed to effect entry block registration and yet the log sheet will remain under tension for imprinting and sensing purposes. Also by elongating the ridge, tension is more uniformly applied over the width of the log sheet.

In operation, the station attendant or other operator may at the beginning of each day or other business period open the recorder and insert a loaded supply cartridge 46 therein as indicated in FIG. 3, although it should be appreciated that certain features of the invention may be utilized even though the log sheets are supplied from a bin, for example, within the base rather than from cartridge 46. The first log may then be connected to the leader 86 of take-up spool 84. The recorder will then be closed and snap fastened together by connectors 141 and 143 (FIG. 12) which project into openings 151 (FIG. 1) of cover 14. The attendant should then depress button 170 of latch 156 to ensure that the latch has been removed on tray 140. Next, he depresses slide 206 to release brake 128. The log sheet is then advanced so that the first data entry block is positioned over the imprinting station of the recorder. Registration with this area is effected by sensing pin 260 which detects the location of the first registration hole on the log sheet. As soon as this hole is sensed, slide 206 is ejected to re-engage the brake 128 and prevent further movement of the log. Also at this time the interlock on the latch 156 is removed whereby the first customer's credit card may be inserted in tray 140 and latched into position in the imprinting area or station.

Figure 19:
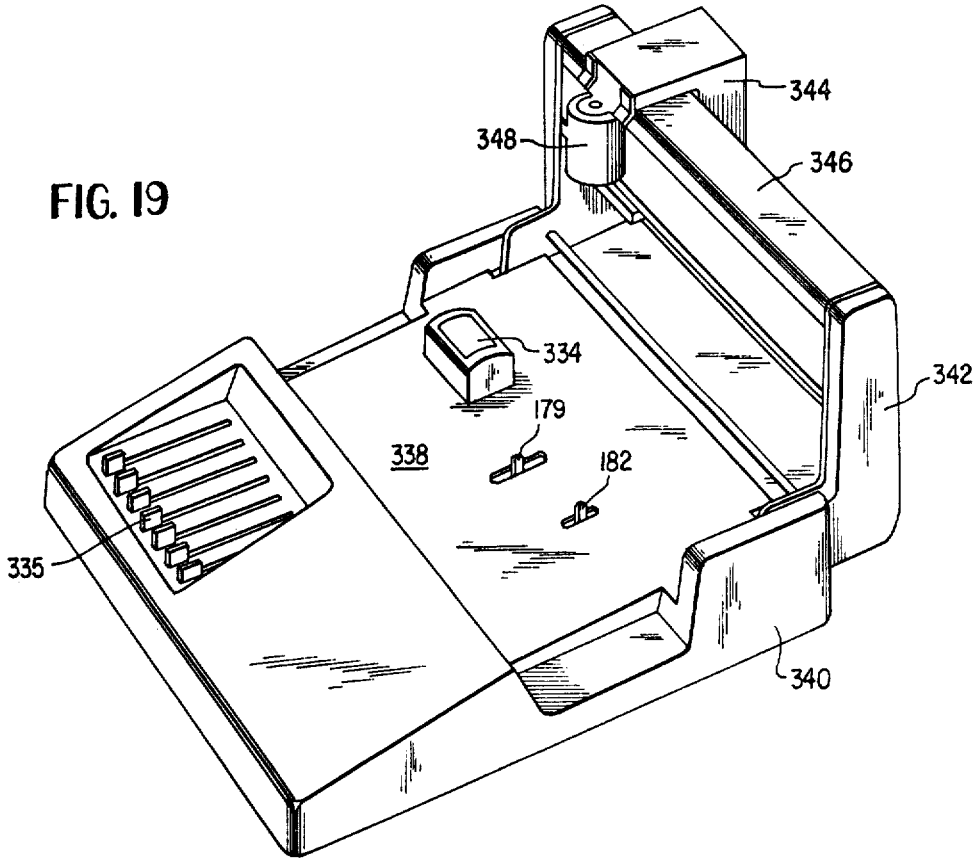
FIG. 19 is a perspective view of an illustrative imprinter with which the recorder of the present invention may be employed.

The imprinting area is generally defined by the credit card tray 140 on frame 132 (see FIG. 10) together with transaction counter wheel 180, dealer identification plate 332, which may be mounted as shown in FIG. 10 to frame 132, and transaction amount and date wheels 334 (see FIG. 19) which extend through opening 336 in frame 132. In general, any or all of the foregoing elements contain lines of print elements or may contain such elements (when a credit card or the like is inserted into tray 140 and the tray is latched in place), which may be employed to define a print field, with which data entry blocks 32 are successively aligned.

Once the customer's credit card has been latched into position in the recorder, invoice 28 is inserted beneath cover 10 on lid 14. The recorder is now inserted within a cavity 338 defined within imprinter 340 of FIG. 19. As is discussed in more detail in aforementioned U.S. Pat. No. 3,983,802, a pivotable cover 342 of the imprinter may then be closed over the recorder preparatory to an imprinting cycle but only after the transaction amount has been entered into the wheels 334 via keys 335. The date wheels are set at the beginning of the day. With the cover 342 in place over the recorder the operator grasps carriage 344 and moves it along rail 346. This in turn moves roller platen 348 over the imprinting area to effect imprinting of the transaction data onto invoice 28 and the registered data entry block of the transaction log. When the imprinting cycle is completed, latch 156 is removed from card tray 140 thereby effecting the automatic ejection of the tray from the recorder under the influence of spring 148. The latch remains disabled due to plate 174. The credit card is then removed from the recorder and returned to the customer who at this time signs the invoice while it is still in place on the recorder. A first copy of the invoice may then be given to the customer while a second copy may be retained by the dealer. Thus, at this time the customer and dealer copies of the invoice together with the current data entry block of the transaction log all contain the same information including the customer's signature.

At this time, both card tray 140 and slide 206 have been ejected from the recorder. Hence, not only is it impossible to latch the credit card of the next customer in place but it is also impossible to advance the log sheet. However, the log sheet must be advanced before the next credit card can be inserted. This is effected by depressing slide 206 into the recorder to thereby position sensing pin 260 beneath the log and to disengage brake 128. At this time the cycle described hereinbefore is repeated.

What is claimed is:

1. A portable transaction log recorder for processing therein at least one transaction log sheet having a plurality of transaction data entry blocks disposed along the length thereof and a plurality of registration holes respectively associated with said data entry blocks, said recorder comprising a base supporting a transport surface having an opening therein;

means supported by said base for removably receiving a printing plate;

supply means disposed on one side of said printing plate receiving means supported by said base for removably storing said transaction log sheet;

take-up means disposed on the other side of said printing plate receiving means supported by said base for advancing said transaction log sheet from said supply means across said transport surface and said printing plate receiving means;

a further surface supported by said base, said log sheet being advanced between said transport surface and said further surface, said further surface having an opening therein in approximate alignment with the opening in the transport surface;

a sensing pin;

first biasing means for biasing said sensing pin toward said transaction log sheet so that said pin extends first through the opening in the transport surface, then through one of said registration holes and then into the opening in the further surface when said one hole and said pin are aligned;

said sensing pin being so located with respect to said printing plate receiving means that when said pin extends through said one registration hole, an associated one of said transaction data entry blocks is aligned with said printing plate receiving means; and means for moving said sensing pin at least beneath said further surface prior to advancement of the next data entry block following said one data entry block to the printing plate receiving means so that said log sheet may be advanced by said take-up means until said sensing pin is urged through the next registration hole following said one registration hole under the influence of said first biasing means;

the upper surface of said sensing pin being so shaped that the sensing pin readily moves beneath said log sheet as the log sheet is advanced.

2. A recorder as in claim 1 where said sensing pin is tapered on the upper surface thereof, the taper rising in the direction of advancement of the log sheet.

3. A recorder as in claim 1 or 2 including a plurality of said transaction log sheets, said log sheets being fan-folded prior to insertion thereof into said supply means and where the distance between the registration holes on said one sheet is different than the distance between the last registration hole on said one sheet and the first registration hole on the following sheet.

4. A recorder as in claim 3 where the distance between registration holes is equal to the distance between data entry blocks.

5. A recorder as in claim 1 or 2 where said next registration hole is round.

6. A recorder as in claim 1 or 2 where said sensing pin is so positioned with respect to said printing plate receiving means in the path of travel of said log sheet that said registration holes encounter said sensing pin prior to encountering said printing plate receiving means.

7. A recorder as in claim 6 where the distance between registration holes is equal to the distance between said sensing pin and a predetermined printing field associated with said printing plate receiving means.

8. A recorder as in claim 1 including anti-back up means for preventing said take-up means from being backed up to thereby prevent backing up of said log sheet over said printing plate receiving means.

9. A recorder as in claim 8 including a lid pivotally mounted with respect to said base so that the lid may assume a first position adjacent the base and a second position removed from the base, said anti-back up means including a member disposed with respect to the lid, said member being in operative relationship with the take-up means to prevent back up of the take-up means when the lid is in its first position, and said member being in non-operative relationship with the take-up means to permit back up of the take-up means when the lid is in its second position to thereby permit removal of the log sheet from the take-up means.

10. A recorder as in claim 9 where said anti-back up means includes a gear operatively associated with the take-up means and a pawl mounted with respect to said lid so that, when said lid is in its first position, the pawl prevents rotation of the gear in a predetermined direction and thus prevents back up of the take-up means.

11. A recorder as in claim 1 including tensioning means supported by said base disposed between said sensing means and said printing plate receiving means for applying tension to said log sheet even after the trailing edge thereof leaves the supply means.

12. A recorder as in claim 11 including a lid pivotally mounted with respect to said base and where said tensioning means includes an elongated raised member supported by said base where said log sheet passes between the raised member and the lid as it is advanced from the supply means, the clearance between said raised member and said lid being such that the transaction log is slideably held between the lid and raised member after the trailing edge of the log sheet leaves the supply means.

13. A recorder as in claim 1 including means for braking said take-up means to thereby maintain said log sheet in a predetermined spatial relationship with respect to said printing plate receiving means, said brake means including a first gear connected to said take-up means;

second and third gears normally in engagement with said first gear and with each other;

a push rod connected at one end thereof to said third gear;

means for biasing said push rod so that said third gear engages said first and second gears to thus engage the brake means; and means connected at the other end of said push rod for disengaging said third gear from said first gear to thus disengage the brake means and permit said take-up means to remove the log sheet from the supply means.

14. A portable transaction log recorder for processing therein at least one transaction log sheet having a plurality of transaction data entry blocks disposed along the length thereof, said recorder comprising a base;

a lid movably mounted with respect to said base so that the lid may assume a first position adjacent the base and a second position removed from the base;

means supported by said base for removably receiving a printing plate;

supply means disposed on one side of said printing plate receiving means supported by said base for removably storing said transaction log sheet;

take-up means disposed on the other side of said printing plate receiving means supported by said base for advancing said transaction log sheet from said supply means across said printing plate receiving means; and anti-back up means for preventing said take-up means from being backed up to thereby prevent backing up of said log sheet over said printing plate receiving means, said anti-back up means including a member disposed with respect to the lid, said member being in operative relationship with the take-up means to prevent back up of the take-up means when the lid is in its first position, and said member being in non-operative relationship with the take-up means to permit back up of the take-up means when the lid is in its second position to thereby permit removal of the log sheet from the take-up means.

15. A recorder as in claim 14 where said anti-back up means includes a gear operatively associated with the take-up means and a pawl mounted with respect to said lid so that, when said lid is in its first position, the pawl prevents rotation of the gear in a predetermined direction and thus prevents back up of the take-up means.

16. A recorder as in claim 14 where said log sheet includes a plurality of registration holes respectively associated with said data entry blocks and where the recorder includes sensing means responsive to said registration holes for successively aligning said data entry blocks with said printing plate receiving means.

17. A recorder as in claim 16 including a plurality of said transaction log sheets, said log sheets being fanfolded prior to insertion thereof into said supply means and where the distance between the registration holes on said one sheet is different than the distance between the last registration hole on said one sheet and the first registration hole on the following sheet.

18. A recorder as in claim 17 where the distance between registration holes is equal to the distance between data entry blocks.

19. A recorder as in claim 16 where said sensing means is so positioned with respect to said printing plate receiving means in the path of travel of said log sheet that said registration holes encounter said sensing pin prior to encountering said printing plate receiving means.

20. A recorder as in claim 19 where the distance between registration holes is equal to the distance between said sensing means and a predetermined printing field associated with said printing plate receiving means.

21. A portable transaction log recorder for processing therein at least one transaction log sheet having a plurality of transaction data entry blocks disposed along the length thereof and a plurality of registration holes respectively associated with said data entry blocks, said recorder comprising a base;

a lid movably mounted with respect to said base;

means supported by said base for removably receiving a printing plate, said printing plate receiving means being movable from a printing position to a non-printing position;

supply means disposed on one side of said printing plate receiving means supported by said base for removably storing said transaction log sheet;

take-up means disposed on the other side of said printing plate receiving means supported by said base for advancing said transaction log sheet from said supply means across said printing plate receiving means;

sensing means responsive to said registration holes for successively aligning said data entry blocks with said printing plate receiving means, said sensing means being so positioned with respect to said printing plate receiving means in the path of travel of said log sheet that said registration holes encounter said sensing means prior to encountering the printing plate receiving means; and tensioning means supported by said base disposed between said sensing means and said printing plate receiving means for applying tension to said log sheet even after the trailing edge thereof leaves the supply means where said tensioning means includes an elongated raised member supported by said base where said log sheet passes between the raised member and the lid as it is advanced from the supply means, the clearance between said raised member and said lid being such that the transaction log is slideably held between the lid and raised member after the trailing edge of the log sheet leaves the supply means.

22. A recorder as in claim 21 where said tensioning means is disposed adjacent the sensing means.

23. A recorder as in claim 21 including a plurality of said transaction log sheets, said log sheets being fanfolded prior to insertion thereof into said supply means and where the distance between the registration holes on said one sheet is different than the distance between the last registration hole on said one sheet and the first registration hole on the following sheet.

24. A recorder as in claim 23 where the distance between registration holes is equal to the distance between data entry blocks.

25. A recorder as in claim 21 where the distance between registration holes is equal to the distance between said sensing means and a predetermined printing field associated with said printing plate receiving means.

26. A portable transaction log recorder for processing at least one transaction log sheet comprising a base;

means supported by said base for removably receiving a printing plate;

supply means disposed on one side of said printing plate receiving means supported by said base for removably storing said transaction log sheet;

take-up means disposed on the other side of said printing plate receiving means supported by said base for removing said transaction log sheet from said supply means across said printing plate receiving means;

means for braking said take-up means to thereby maintain said log sheet in a predetermined spatial relationship with respect to said printing plate receiving means, said brake means including a first gear connected to said take-up means;

second and third gears normally in engagement with said first gear and with each other;

a push rod connected at one end thereof to said third gear;

means for biasing said push rod so that said third gear engages said first and second gears to thus engage the brake means; and means connected at the other end of said push rod for disengaging said third gear from said first gear to thus disengage the brake means and permit said take-up means to remove the log sheet from the supply means.

27. A recorder as in claim 26 where said third gear is pivotally mounted with respect to said first gear and said push rod pivots said third gear out of engagement with said first gear to thereby disengage the brake means.

28. A recorder as in claim 26 where said log sheet includes a plurality of registration holes respectively associated with said data entry blocks and where the recorder includes sensing means responsive to said registration holes for successively aligning said data entry blocks with said printing plate receiving means.

29. A recorder as in claim 28 including a plurality of said transaction log sheets, said log sheets being fanfolded prior to insertion thereof into said supply means and where the distance between the registration holes on said one sheet is different than the distance between the last registration hole on said one sheet and the first registration hole on the following sheet.

30. A recorder as in claim 29 where the distance between registration holes is equal to the distance between data entry blocks.

31. A recorder as in claim 28 where said sensing means is so positioned with respect to said printing plate receiving means in the path of travel of said log sheet that said registration holes encounter said sensing pin prior to encountering said printing plate receiving means.

32. A recorder as in claim 31 where the distance between registration holes is equal to the distance between said sensing means and a predetermined printing field associated with said printing plate receiving means.

* * * * *